United States Patent [19]

Caveney et al.

[11] Patent Number: 4,481,710

[45] Date of Patent: Nov. 13, 1984

[54] TOOL FOR APPLYING CONNECTORS

[75] Inventors: Jack E. Caveney, Hinsdale; Roy A. Moody, Flossmoor; John J. Bulanda, New Lenox, all of Ill.

[73] Assignee: Panduit Corp., Tinley Park, Ill.

[21] Appl. No.: 437,413

[22] Filed: Oct. 28, 1982

[51] Int. Cl.[3] ..... H01R 43/04

[52] U.S. Cl. ..... 29/749; 29/753; 29/759; 29/760

[58] Field of Search ..... 29/749, 751, 753, 759, 29/760, 861, 863

[56] References Cited

U.S. PATENT DOCUMENTS

| | | | |
|---|---|---|---|
| 3,434,093 | 3/1969 | Wedekind | 339/17 F |
| 4,148,130 | 4/1979 | Stauffer et al. | 29/749 X |
| 4,160,317 | 7/1979 | Sargeant | 29/749 |
| 4,188,083 | 2/1980 | Knowler | 339/99 R |
| 4,245,387 | 1/1981 | Reidt | 29/749 |
| 4,281,442 | 8/1981 | Senior et al. | 29/749 X |
| 4,332,083 | 6/1982 | Johnson, Jr. et al. | 29/749 |
| 4,359,257 | 11/1982 | Lopinski et al. | 339/99 R |
| 4,393,580 | 7/1983 | Hall, Jr. | 29/749 |

OTHER PUBLICATIONS

Bulletin 14–231; Gardner Denver.

*Primary Examiner*—Carl E. Hall

*Attorney, Agent, or Firm*—Charles R. Wentzel; Mark D. Hilliard

[57] ABSTRACT

A tool for applying an elongate connector to a plurality of insulated conductors. The connector includes a base and a cover with the base having a plurality of insulation displacement terminal elements extending toward the cover. The base and cover are joined by interconnection means for holding the connector in an insertion position for receiving the conductors. The base and cover are movable from the insertion position to a connector termination position in which the elements engage the conductors. The tool includes a die for moving the connector to its termination position, holding means for positioning the connector with respect to the die and prime mover means connected to cause the die and a component of the holding means to undergo reciprocal movement relative to one another. The holding means includes stop means positioned to engage the connector when it is in its insertion position. The stop means is spaced from the connector when the connector has been moved to its termination position whereby, prior to termination, the stop means maintains the connector in alignment with the die and, after termination, the connector can be removed from the tool without interference from the stop means.

8 Claims, 15 Drawing Figures

TOOL FOR APPLYING CONNECTORS

BACKGROUND OF THE INVENTION

This invention relates to a connector and a terminator therefor and, more specifically, to an insulation displacement mass termination flat cable connector and an attendant terminator.

Insulation displacement mass termination connectors have come into increasing use because of the great savings in the labor and time they offer in comparison with the previous method of stripping the insulation from each individual conductor and applying a crimp terminal to the bared end of each. Mass termination connectors have been specifically designed for use with a flat cable wherein a series of regularly spaced conductors are embedded in a planar sheet of insulation. Such connectors typically include an aligned base and a cover with a series of regularly spaced metallic terminal elements carried by the base and extending toward the cover. The leading end of each element is bifurcated and sharply pointed for piercing the insulation of the flat cable and engaging a corresponding conductor. The base and cover are joined at each end by a post for holding the base and cover in an insertion position so that a flat cable can be inserted between the terminal elements and the cover. Examples of such prior art flat cable connectors are illustrated in U.S. Pat. Nos. 4,106,838 and 4,188,083. These connectors can be applied adjacent the end of a length of flat cable when a dead end connection is desired or they can be applied intermediate the ends of the cable when a daisy chain connection is required.

These prior art flat cable connectors are typically used with a manual press having a connector holder opposing a reciprocal ram carrying a presser foot for pushing the cover toward the base thereby terminating the flat cable. A common difficulty of the prior art connectors and terminators is that while they can be easily used for dead end connections, they are difficult to use when a daisy chain connection is required because the flat cable must be inserted from the side of the connector and then threaded sufficiently so that the proper placement of the connector is achieved. Also the use of such terminators and connectors requires the operator to place each connector in the tool and then manually remove the completed termination.

SUMMARY OF THE INVENTION

Among the several objects of the present invention may be noted the provision of an improved flat cable connector and a terminator therefor; the provision of such connector and terminator which allows either daisy chain or dead end connections; the provision of such connector and terminator which permits formation of a daisy chain connection even though neither end of the flat cable is accessible; the provision of such terminator which limits insertion of the cable into the connector for dead end connections; the provision of such terminator which, after initial loading of a series of connectors, obviates the need for the operator to touch either the terminator or connector during the process of applying the connectors; and the provision of such terminator and connector which has long service life and is simple and economical to manufacture. Other objects and features of the present invention will be in part apparent and in part pointed out hereinafter in the specifications and claims.

Briefly, the tool of the present invention is for applying an elongate connector to a flat cable. The connector includes a base and a cover with the base having a plurality of insulation displacement terminal elements extending toward the cover. The base and cover are joined by interconnection means for holding the connector in an insertion position for receiving the flat cable. The base and cover are movable from the insertion position to a termination position in which the elements engage the conductors of the flat cable. The tool includes a die for moving the connector to its termination position, holding means for positioning the connector with respect to the die and prime mover means connected to cause the die and a component of the holding means to undergo reciprocal movement relative to one another. The holding means includes stop means positioned to engage the connector when it is in its insertion position. The stop means is spaced from the connector when the connector has been moved to its termination position whereby, prior to termination, the stop means maintains the connector in alignment with the die and, after termination, the connector can be removed from the tool without interference from the stop means.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
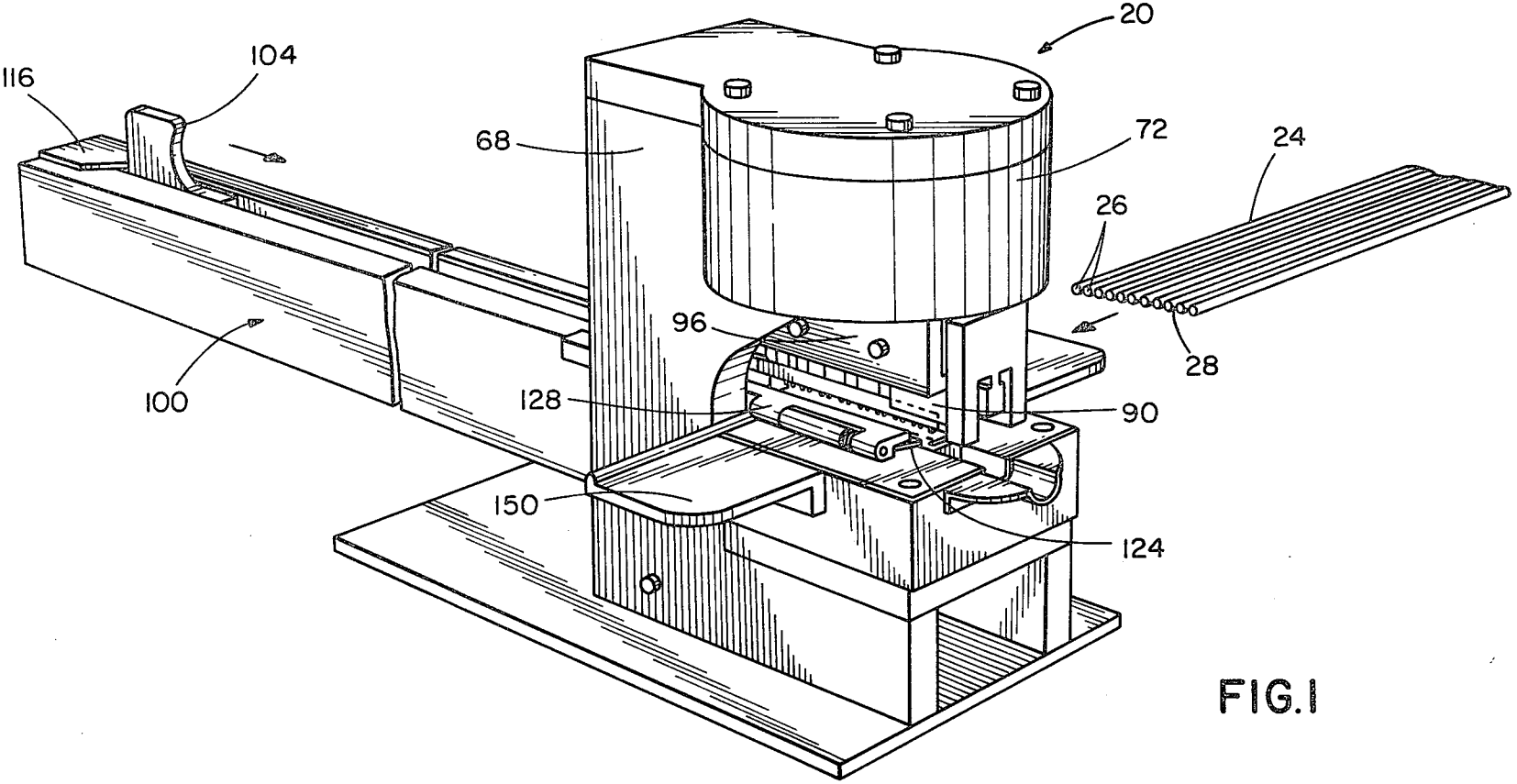
FIG. 1 is a perspective view of a terminator for mass termination connectors.

Referring now to the drawings, a terminator for applying insulation displacement mass termination flat cable connectors 22 is generally indicated in FIG. 1 by reference numeral 20. The terminator functions to apply a series of connectors, one at a time, to a length of flat cable 24 in which a plurality of regularly spaced conductors 26 are embedded in a generally planar sheet of insulation having web portions 28 disposed between adjacent conductors. The terminator is adapted to apply connectors adjacent the ends of the cable to effect dead end terminations and to apply connectors intermediate the cable ends when a daisy chain connection is desired. While the terminator and connector are primarily intended for use with a flat cable, they can also be used with discrete insulated conductors.

Figure 2:
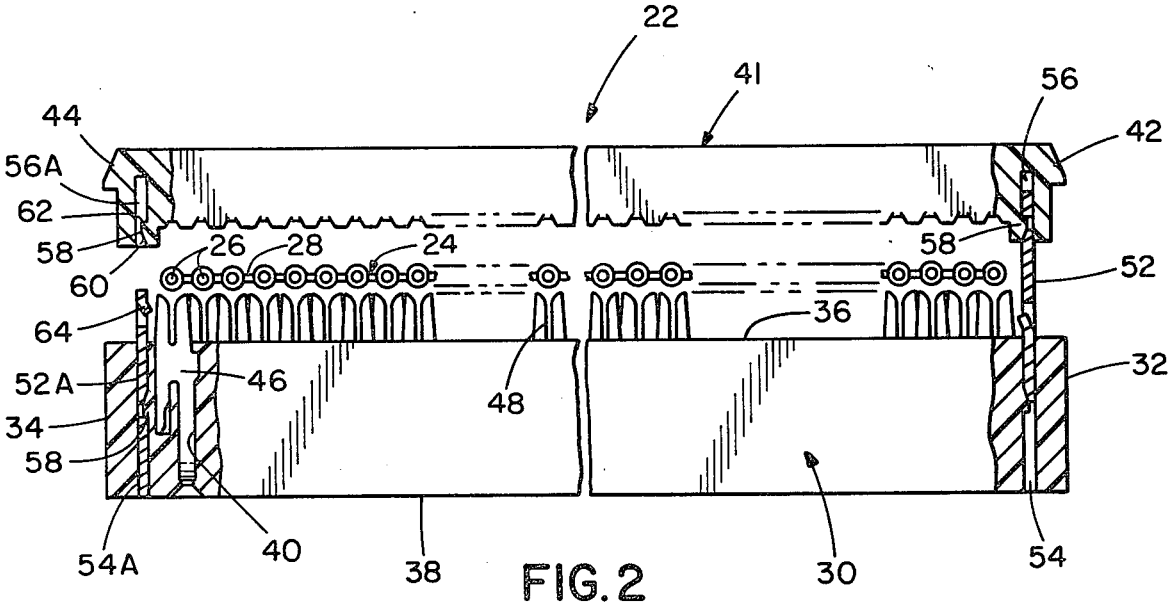
FIG. 2 is a front elevational view of an insulation displacement, mass termination connector for use with the terminators with the connector in its insertion position.
Figure 3:
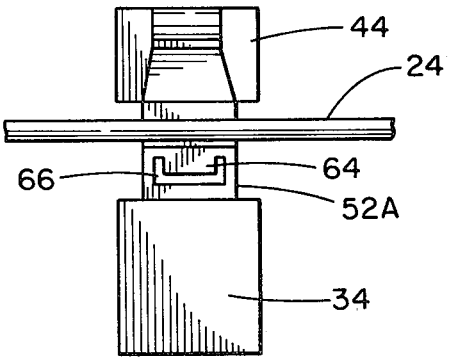
FIG. 3 is an end view of the connector of FIG. 2.
Figure 4:
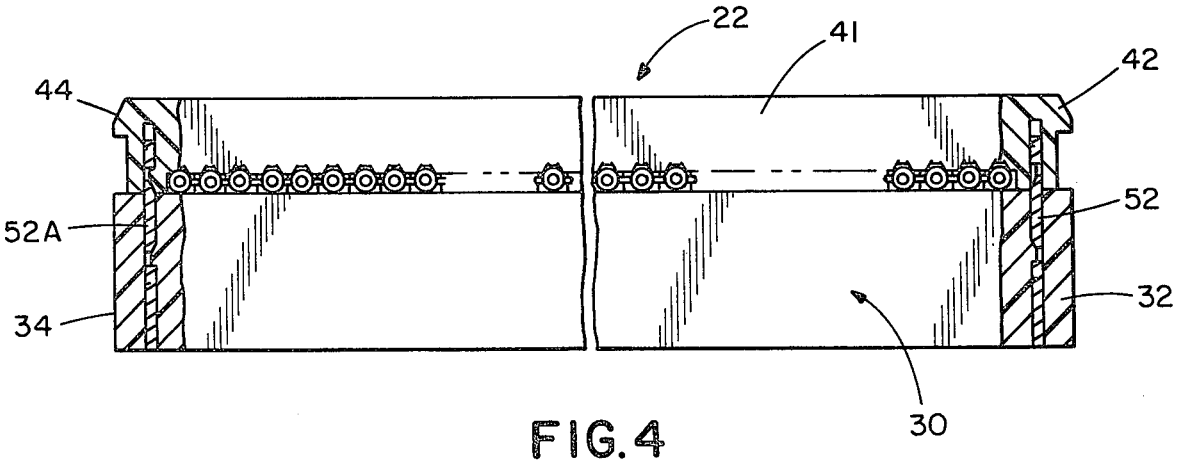
FIG. 4, similar to FIG. 2, shows the connector in its termination position.

Connector 22 is best shown in FIGS. 2–4 and includes an elongate insulative base 30 having a first end 32, a second end 34, a top surface 36, a bottom surface 38 and an array of terminal element receiving apertures 40 corresponding in number to the flat cable conductors and extending through the top and bottom surfaces. Apertures 40 are preferable arranged in two rows with adjacent apertures in each row being offset to match the spacing of the flat cable conductors. Connector 22 also comprises an insulative cover 41 overlaying said base and having a first end 42 and a second end 44. Base 30 carries a metallic terminal element 46 in each aperture 40. Each element includes a pin receiving portion disposed within the base for engaging another electrical component inserted past the bottom surface of the base, and an insulation displacement conductor termination portion 48 extending beyond the top surface toward cover 41. The conductor termination portion is bifurcated to form a conductor-receiving slot and is sharply pointed to pierce the flat cable web and engage a corresponding conductor of a flat cable moved laterally of its axial direction toward said base.

The connector also includes interconnection means joining the base and cover adjacent their respective first ends 32, 42. The interconnection means includes a first generally planar metallic clip 52 disposed in an interference fit in a through opening 54 in the base and in a closed ended opening 56 in the cover. As shown in FIG. 2, clip 56 holds the cover and base in an insertion position wherein the spacing between the terminal elements and the cover is sufficient for passage of flat cable 24.

The respective second ends 34, 44 of the base and cover also have openings 54A and 56A; however the clip 52A, which constitutes a second interconnection means, disposed at the second end of the connector is positioned, in the insertion position of the connector, to extend fully through said base so that it is spaced sufficiently from the cover to permit passage of a flat cable past the second end of the connector. Thus when the connector is in its insertion position a flat cable can be inserted from either side and, additionally, can be inserted from the second end of the connector.

The base and cover are relatively movable from the insertion position to a termination position, shown in FIG. 4 wherein the overall height of connector 22 is reduced and the various conductors of the flat cable are electrically and mechanically terminated in corresponding terminal elements. The connector also comprises latch means for holding the connector in its termination position. Each opening 54, 54A, 56 and 56A has an internal tooth 58 having a ramp surface 60 and an abutment surface 62. Also each clip has a pair of spaced converging resilient tongues 64 defined by "U" shaped windows 66 with the tongues being bent slightly to extend from the plane of the clip to engage a corresponding internal tooth. As the connector is moved toward its termination position, clip 52 advances into opening 54 until the lower tongue passes the abutment surface of the tooth in opening 54. Also clip 52 advances into second end cover opening 56A causing the upper tongue to be deflected by the ramp surface of the opening 56A tooth until that tongue passes the abutment surface of that tooth. As shown in FIG. 4 when the connector has moved to its termination position, each clip tongue is facing a corresponding tooth abutment surface to prevent opening of the connector.

Figure 5:
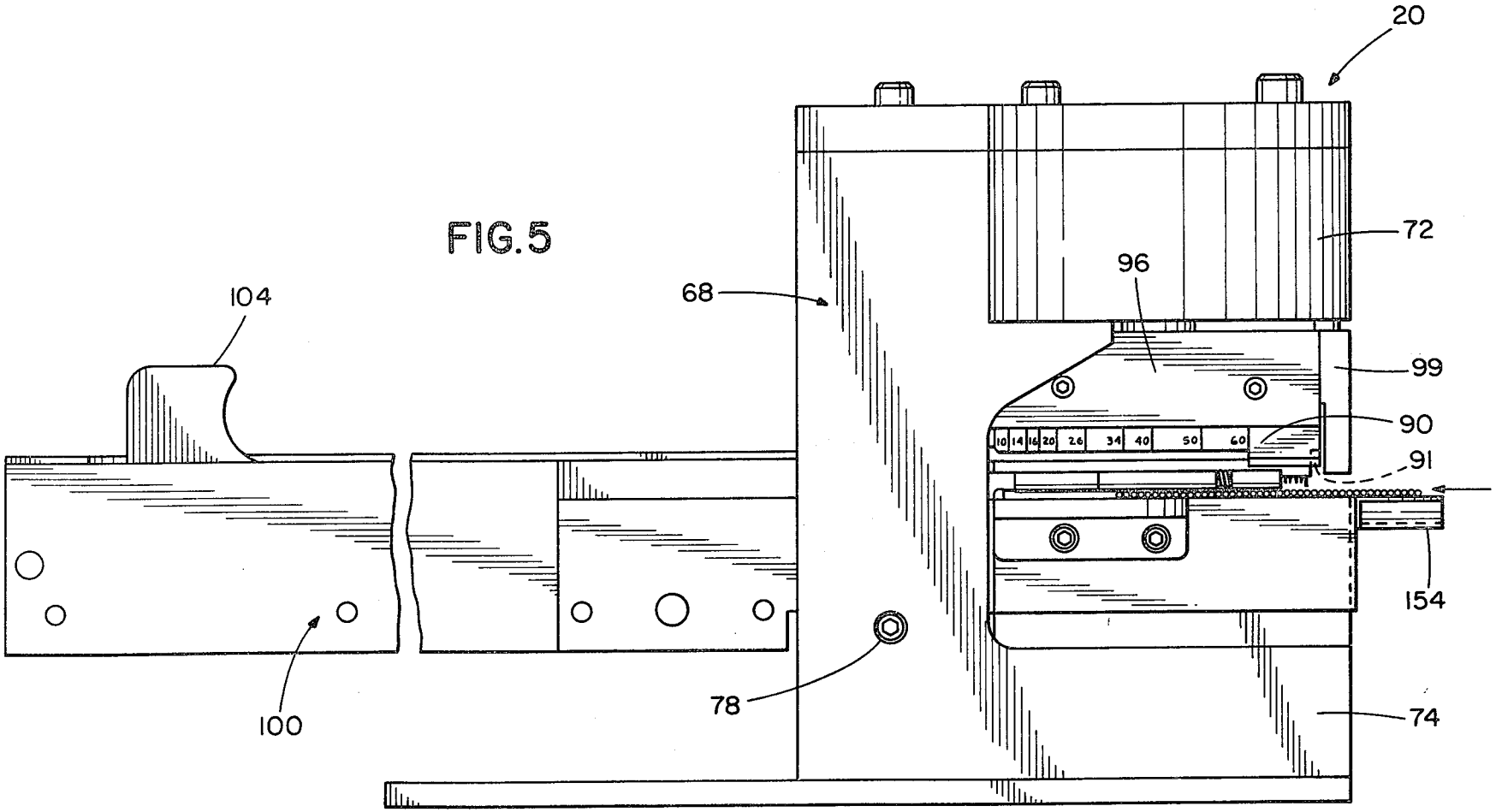
FIG. 5 is a side elevational view of the terminator of FIG. 1 showing a flat cable being inserted through the open end of a connector to form a daisy chain connection.
Figure 6:
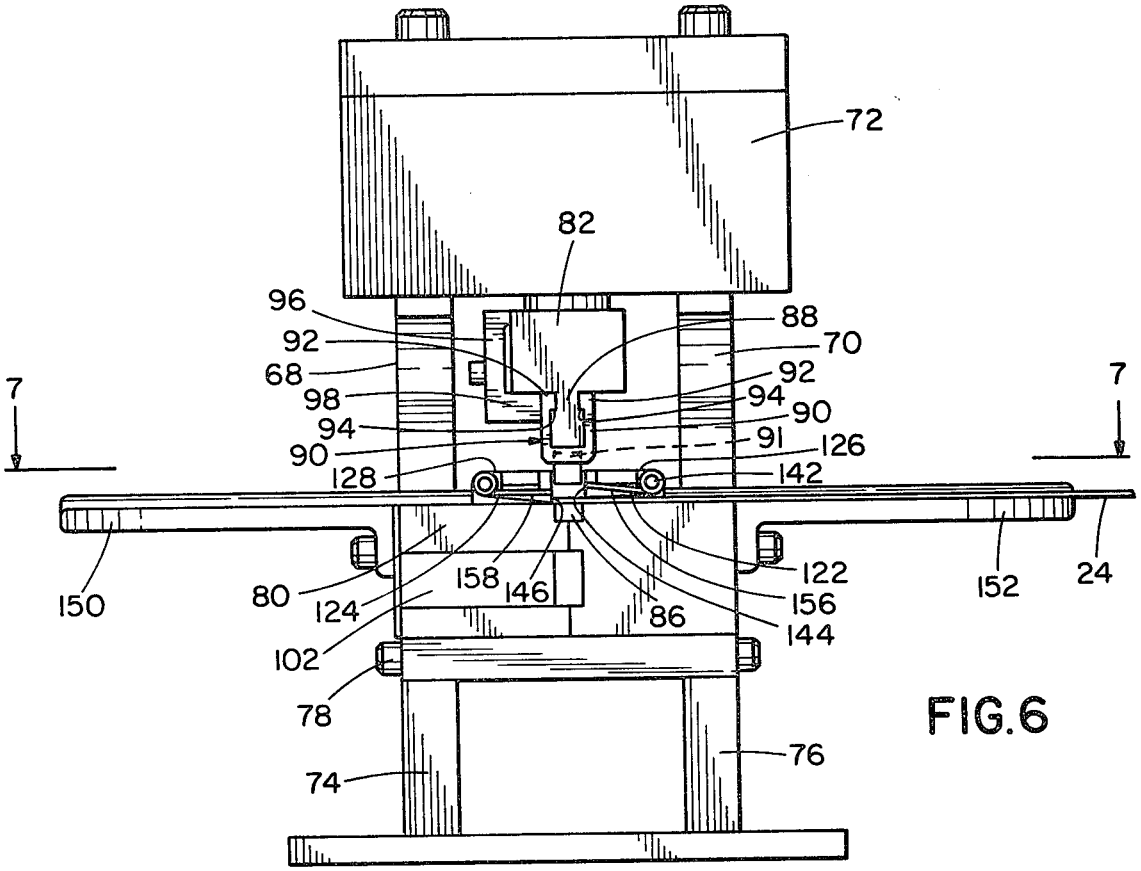
FIG. 6 is a front elevational view of the terminator showing a cable inserted for a dead end termination.
Figure 7:
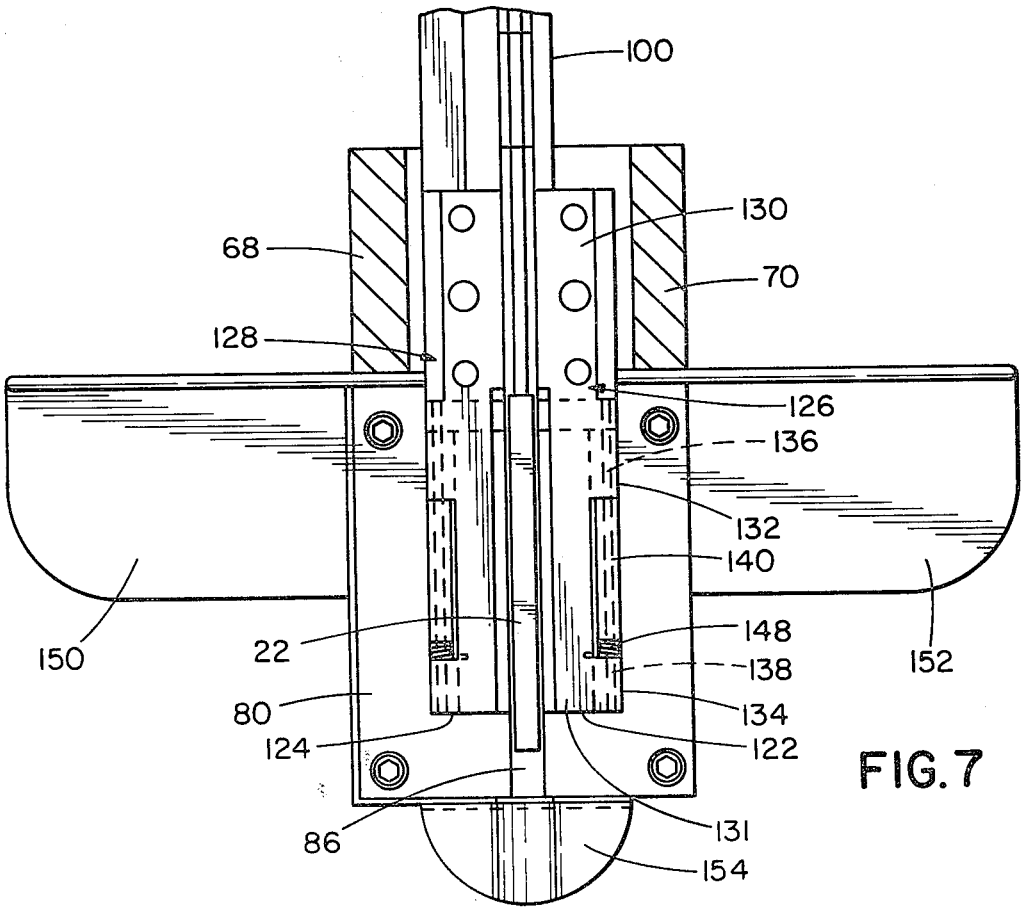
FIG. 7 is sectional view taken generally along line 7—7 of FIG. 6.

Referring now to FIGS. 5–7, terminator 20 is adapted for bench mounting and comprises a frame including a pair of spaced "C" shaped plates 68, 70 joined at their upper arms by the housing of an air cylinder 72 and at their lower arms 74, 76 by an elongate bolt 78. Mounted on lower arms 74, 76 is a base 80 having holding means for positioning a connector 22 in lateral alignment with a ram 82 of the rod of cylinder 72. The holding means includes a channel 86 for seating the connector. Ram 82 has a dependent presser foot or die 88 for engaging the connector to move it to its termination position after cable insertion. In the interest of brevity, air lines, fittings and control valves for cylinder 72 are not shown as their placement is readily apparent to one of ordinary skill in the art. Suffice it to say that ram 82 extends in response to actuation of a control device such as a foot treadle and retracts in response to deactivation of the control device.

The connector holding means also includes stop means, slidably carried by presser foot 88, for engaging a connector disposed in channel 86 to provide longitudinal alignment of the connector with the presser foot. More specifically, the stop means comprises a channel shaped stop 90 the arms of which have inwardly directed fingers 92 which ride on opposite shoulders 94 of the presser foot. The arms are interconnected by a web 91 for abutting the connector 22. As shown in FIG. 5, the side of the presser foot carries indicia denoting the proper placement of stop 90 for connectors having various numbers of circuits (terminal elements). Bolted to ram 82 is an "L" shaped clamp 96 the tightening of which causes the clamp horizontal leg 98 to compress the stop against the presser foot thereby fixing the position of the stop. Ram 82 also carries an end piece 99 to prevent inadvertent removal of stop 90 from presser foot 88. The spacing between stop 90 and the base of channel 86 is less than the height of connector 22 in its insertion position but greater than the height of a connector moved to its termination position thus permitting a terminated connector to pass through the channel beneath the level of stop 90.

Figure 8:
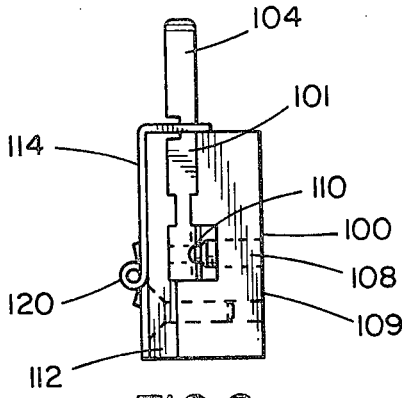
FIG. 8 is an end elevational view of a feed track carried by the terminator for holding a series of connectors.
Figure 9:
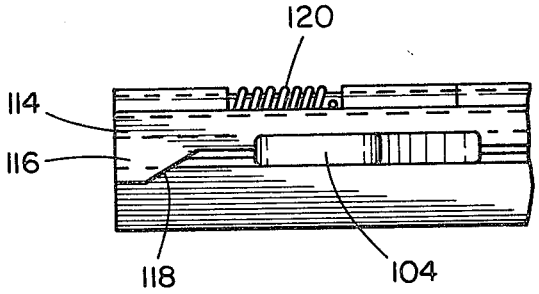
FIG. 9 is a partial plan of connector guard for the feed track.

Attached to supply a series of connectors cover down and open end first to channel 86 opposite stop 90 is a feed track 100. The feed track includes means for biasing a series of connectors toward the holding means in the form of a pusher 101 powered by a negator spring 102 for applying constant force to the last connector of the series. The negator spring, in part, constitutes ejection means for moving a terminated connector past stop 90. As best shown in FIGS. 5, 8 and 9 the pusher has a finger piece 104 for retracting the pusher to permit loading of connectors in the feed track. One wall 109 of the feed track has a spring plunger 108, the ball of which engages a shoulder 110 of the pusher to retain the pusher in its retracted position. The other wall 112 of the feed track pivotally carries an elongate inverted L-shaped track cover 114 movable between a closed position wherein it overlays connectors positioned in the track to prevent their escape and an open position to permit loading on the connectors into the track. As shown in FIG. 9, one end of the cover has a nose 116 having a ramp surface 118 for engaging finger piece 104. When the pusher is pulled to its retracted position, finger piece 104 engages nose 116 camming the track cover to its open position. Upon pulling the pusher from its retracted position after the connectors have been loaded, track cover 114 is biased by a torsion spring 120 to its closed position.

Terminator 20 also comprises cable guide means for directing a flat cable into a connector retained in channel 86 either through the open end of the connector (for a daisy chain connector) or from either of the connector (for dead end connections). The cable guide means comprises a pair of deflectable arms 122, 124 with one positioned on each side of channel 86. Arm 122 is pivotally retained in a right cable guide support 126 while arm 124 is pivotally retained in a left cable guide support 128. As support 126 with its arm 122 is symmetrical with support 128 with its arm 124 about a vertical plane through the center line of channel 86, only support 126 and arm 122 need be described in detail.

Referring now to FIGS. 7 and 12–15, cable guide support 126 (best shown in FIGS. 7 and 15) includes a mount 130 connected to base 80 adjacent feed track 100. Extending from the mount opposite the feed track is a horizontal wall 131 having an enlarged bifurcated portion with each bifurcation 132, 134 having a concentric bore 136, 138. One side of arm 122 carries a barrel 140 disposed between the bifurcations and arm 122 is pivotally mounted to extend between wall 131 and base 80 by a pivot pin 142 disposed in barrel 140 and bores 136 and 138. As shown in FIG. 6, arms 122 and 124 extend from their respective pivotal connections toward channel 86 and the distal side 144, 146 of each respective arm 122, 124 serves as an abutment to limit insertion of a flat cable through the connector. Right arm 122 is shown in its deflected position permitting entrance of a cable from the right side into the connector while left arm is in its stop position to limit insertion of the cable past the connector. Similarly, insertion of a cable from the left side deflects left arm 124 to allow entrance of the cable while the right arm limits insertion. Pivot pin 142 carries a torsion spring 148 working against wall 131 and arm 122 to bias arm 122 to its stop position while arm 124 is provided with another torsion spring to bias it to its stop position.

The cable guide means also include left, right and front shelves 150, 152 and 154 mounted to base 80 for guiding the flat cable toward the connector. The respective ends 156, 158 of arms 122, 124 disposed adjacent front shelf 154 are upturned so that a cable inserted from the front through the open end of the connector cams arms 122, 124 to their deflected position.

Figure 10:
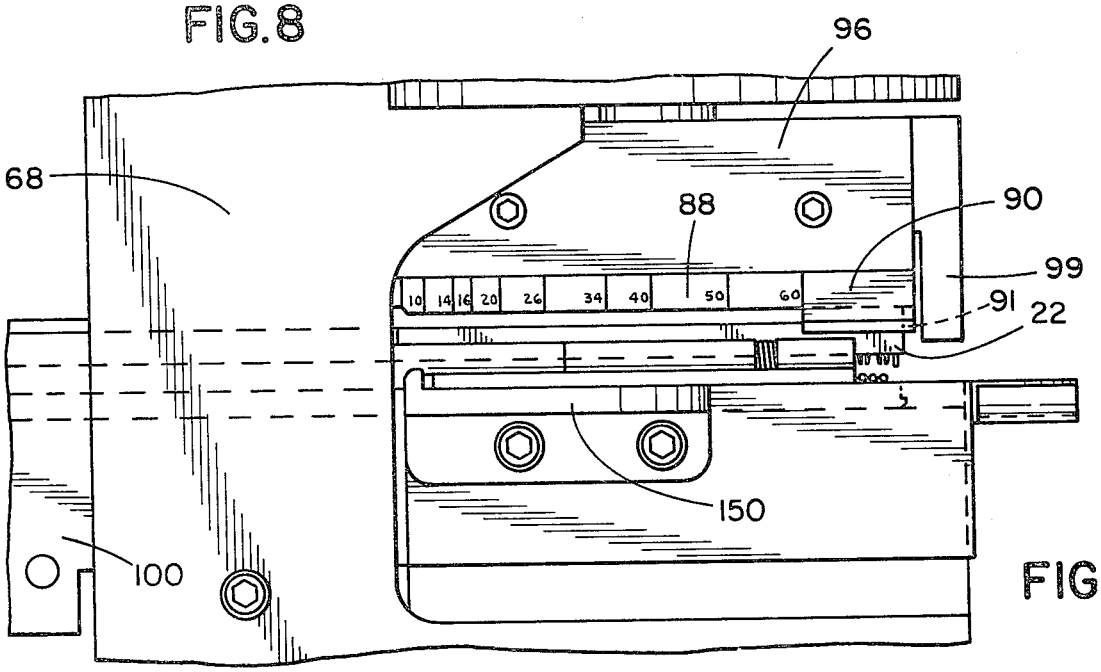
FIG. 10 illustrates a connector in its insertion position abutting a stop for aligning the connector with a ram.
Figure 11:
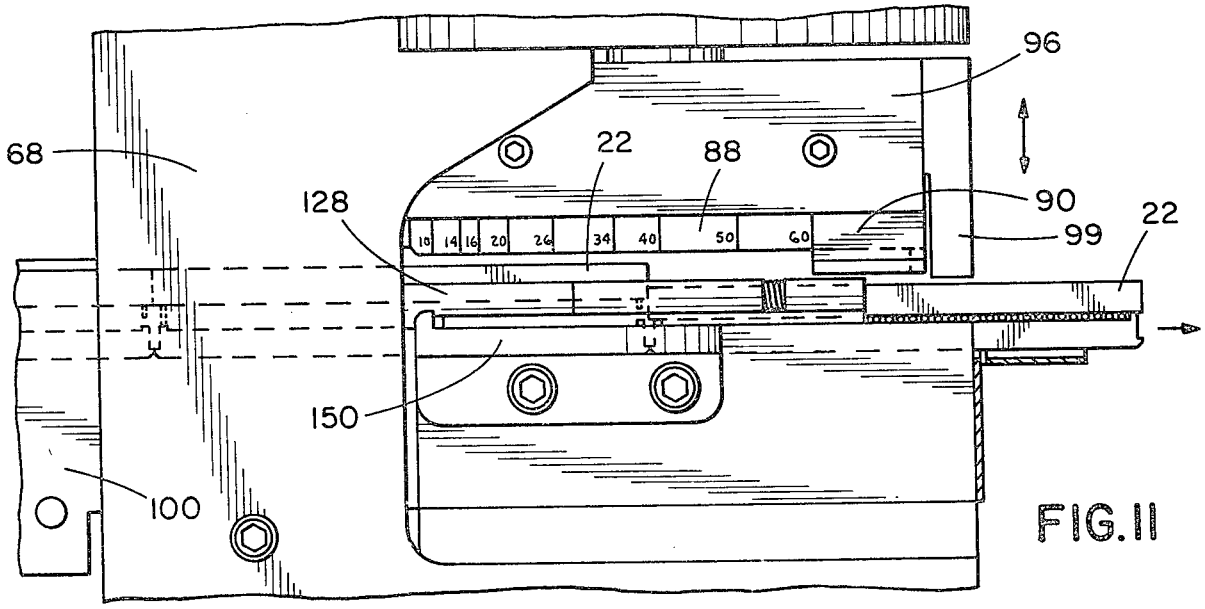
FIG. 11 illustrates the connector of FIG. 10 in its terminated position being pushed past the stop by a subsequent connector.
Figure 12:
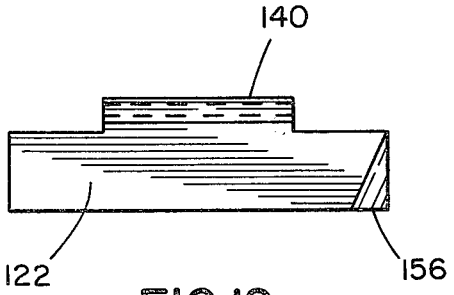
FIGS. 12, 13 and 14 are, respectively, plan, side and front elevational views of one of a pair of cable guides incorporated in the terminator.
Figure 13:
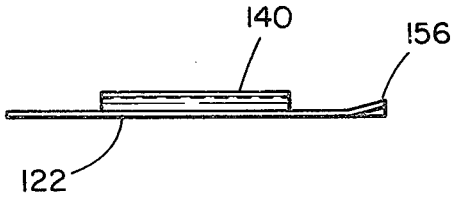
Figure 14:
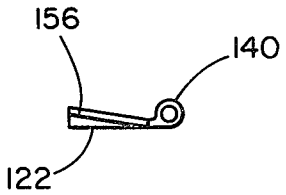
Figure 15:
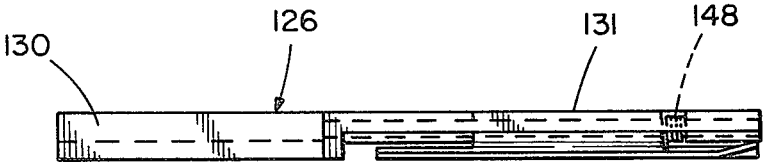
FIG. 15 is a front elevational view of a support for the cable guide shown in FIG. 12.

Operation of the terminator 20 of the present invention is as follows:

With pusher 101 disposed in its retracted position a series of connectors 22 are loaded in feed track 100 oriented cover down with their open ends disposed toward stop 90. Upon completion of loading, the pusher is pulled from its retracted position causing track cover 114 to close, thus preventing escape of connectors from the feed track. Due to the force of negator spring 102, the leading connector is moved against the web 91 of stop 90 as shown in FIG. 10. If a daisy chain connection is desired, the flat cable is placed on front shelf 154 and moved into the connector past its open end until the flat cable conductors are aligned with respective terminal elements 46. This movement causes arms 122 and 124 to move to their deflective positions. Operation of air cylinder 72 results in movement of connector 22 to its terminated position which allows the connector to be moved beneath the level of stop 90 by the next connector which is pushed by the negator spring into engagement with the stop, thus preparing the terminator for another termination. It should be appreciated that the flat cable can be inserted and the termination effected without the operator touching either the connector or the terminator.

A dead end connection can be completed to the left end of the flat cable by placing the cable on right shelf 52 and pushing the cable, thus deflecting right arm 122 with left arm 124 abuting the cable end after it has passed the connector. Again the air cylinder can be actuated to terminate the cable and the negator spring loads another flat cable in channel 86 against web 91. Of course, a dead end connection can be effected at the right end of a cable in similar fashion by placing the cable on left shelf 150 and pushing it into the connector. Thus the terminator and connector of the present invention cooperate to enable the operator to accurately and quickly make either daisy chain or dead end connections.

As a method of terminating flat cable 24 in connector 22 when the ends of the flat cable are maintained remote from the connector, the present invention includes the following steps:

(1) An intermediate portion of the flat cable is inserted between the respective second ends 34 and 44 of the cover and base by effecting relative movement between the connector and the flat cable. It will be appreciated that one way of carrying out this step is by moving a connector with respect to a stationary flat cable.

(2) The respective flat cable conductors 26 are aligned with the termination portions 48 of their corresponding terminal elements 46.

(3) The base 30 and cover 41 are moved to the connector termination position shown in FIG. 4.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. A tool for applying an elongate connector to a plurality of insulated conductors, said connector comprising a base and a cover with said base having a plurality of spaced insulation displacement metallic terminal elements extending toward said cover and corresponding in number and position to said conductors, said cover and base being joined by interconnection means holding said connector in an insertion position wherein the spacing between said elements and said cover is greater than the thickness of said conductors, said cover and base being interconnected in the insertion position only adjacent respective first ends of said cover and base so that said conductors can be inserted past the respective second ends of said cover and base, said base and cover being relatively movable to a connector termination position wherein the spacing between said elements and cover is less with each terminal element engaging a corresponding conductor, said tool comprising:

a die for moving said connector to its termination position;

holding means for positioning said connector with respect to said die;

prime mover means connected to cause said die and a component of said holding means to undergo reiprocal movement relative to one another, said holding means comprising stop means positioned to engage siad connector when it is in the insertion position, said stop means being spaced from said connector when the connector is in its termination position whereby, prior to termination, said stop means maintains said connector in alignment with said die and, after termination, said connector can be removed from said tool without interference from said stop means.

2. A tool as set forth in claim 1 further comprising ejection means for moving a terminated connector past said stop means.

3. A tool as set forth in claim 1 further comprising cable guide means for directing said conductors into said connector past said respective seconds ends whereby said tool can apply a connector in a daisy chain position although neither end of said conductors is accessible.

4. A tool as set forth in claim 3 wherein said cable guide means comprises a deflectable arm positioned adjacent one side of a connector disposed in said holding means for directing a conductor to be inserted from said one side of said connector and for abutting a conductor inserted from the other side of said connector to limit insertion of the last mentioned conductor when a dead end termination is to be formed.

5. A tool as set forth in claim 4 wherein said cable guide means comprises one of said deflectable arms positioned adjacent each side of a connector disposed in said holding means, each arm having a stop position for limiting movement of the end of a conductor past said connector and each arm being deflectable from said stop position by a conductor moving toward said connector, each arm being biased to its stop position whereby said cable guide means permits entry of a conductor past the respective second ends of the cover and base to effect a daisy chain connection and permits entry and limits movement of a conductor from either side of said connector to form a dead end termination.

6. A tool as set forth in claim 4 wherein said arm comprises an upturned lip disposed adjacent the second ends of said base and cover, said lip being engageable with a conductor being inserted into said connector past said second ends to deflect said arm.

7. A tool as set forth in claim 1 further comprising a feed track joined to said holding means, said feed track including means for biasing a series of connectors toward said holding means whereby after a connector has been moved to its terminated position and no longer has sufficient height to engage said stop means, said biasing means advances the next upstream connector into engagement with said stop means thus ejecting the terminated connector from said holding means.

8. A tool as set forth in claim 1 wherein said conductors are included in a flat cable.

* * * * *